United States Patent [19]

Bals

[11] 4,221,332

[45] Sep. 9, 1980

[54] ROTARY ATOMIZER WITH STACKED CONES

[75] Inventor: Edward J. Bals, Bromyard, England

[73] Assignee: Pennbrook Corporation, Far Hills, N.J.

[21] Appl. No.: 942,159

[22] Filed: Sep. 14, 1978

[30] Foreign Application Priority Data

Sep. 14, 1978 [GB] United Kingdom ..... 38247/77

[51] Int. Cl.[2] ..... B05B 3/02

[52] U.S. Cl. ..... 239/223; 239/500

[58] Field of Search ..... 239/500, 222.11, 222.13, 239/223.15, 222.17, 222.19, 222.21, 501, 102, 223, 224, 382, 383, 483, 523

[56] References Cited

U.S. PATENT DOCUMENTS

| | | | |
|---|---|---|---|
| 2,220,275 | 11/1940 | Preston | 239/223 |
| 2,369,216 | 2/1945 | Crisp | 239/223 |
| 3,250,473 | 4/1966 | Hege | 239/224 |

*Primary Examiner*—James B. Marbert

*Attorney, Agent, or Firm*—Schuyler, Birch, McKie & Beckett

[57] ABSTRACT

A rotary atomizer suitable for spraying crops with liquid comprising a stack of hollow truncated cones with internal grooves spaced apart by ribs mating with some of the grooves and held together on a central, stationary spindle by thrust bearings at either end.

The central spindle may be hollow with holes from the interior to the exterior for feeding liquid to the cones.

7 Claims, 2 Drawing Figures

ROTARY ATOMIZER WITH STACKED CONES

Figure 1:
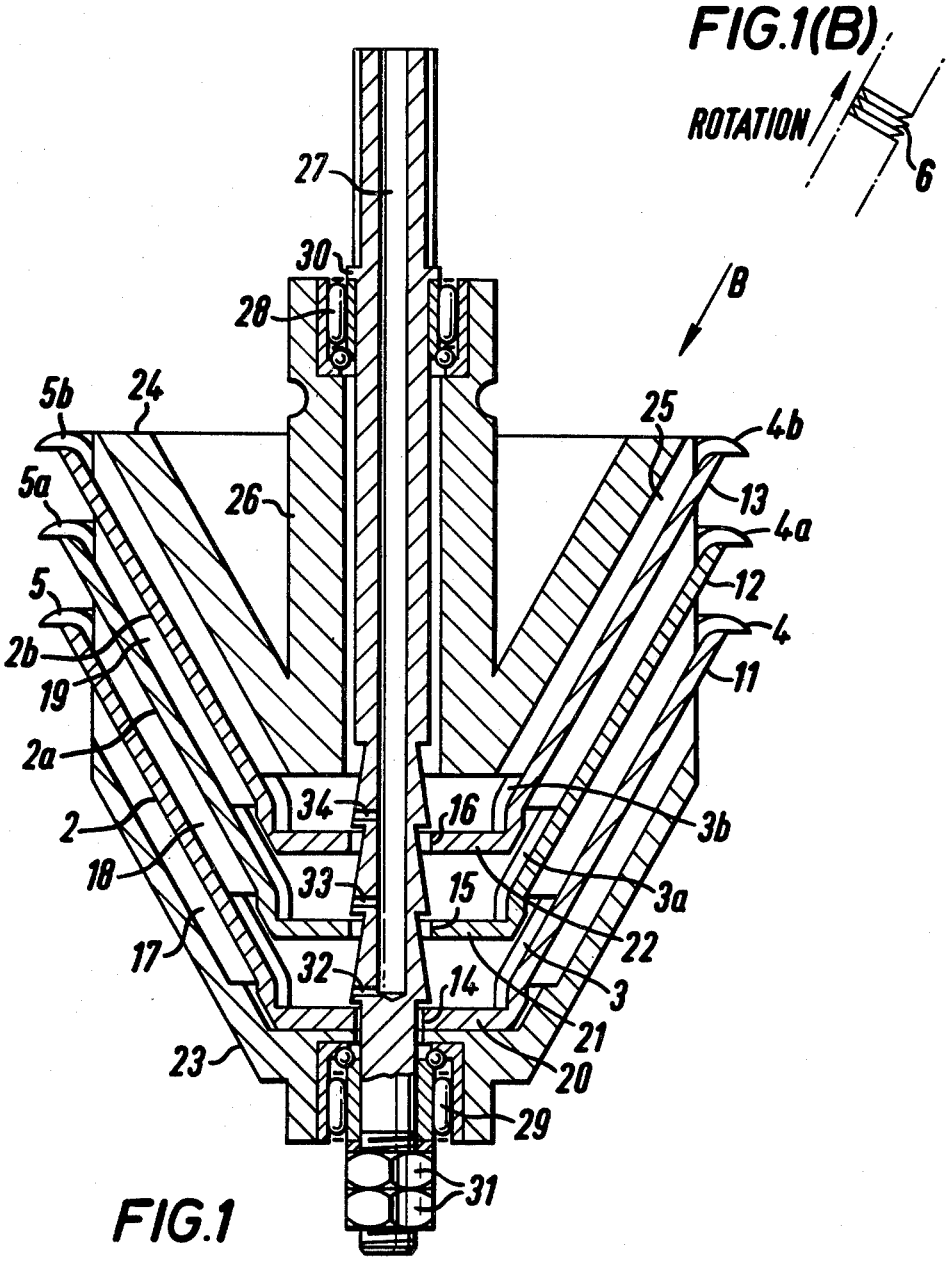

This invention relates to rotary atomisers, and has particular, though not exclusive, application to crop-spraying equipment.

Liquid sprays are applied to crops and agricultural land for a variety of reasons, but a principal use is for the application of pesticides, which may be herbicides, insecticides or fungicides. For efficient use of these relatively costly materials it is important that the droplets in the spray are of a size suitable for the application (usually between 20–500 microns diameter). Ideally the droplets should be of a completely uniform size, and the nearer this ideal can be approached the better.

Conventional pressure atomisers are not capable of giving uniform size droplets, so rotary atomisers are preferred, e.g., discs or hollow cones. Liquid is fed to the center of the atomiser, and rotation results in migration of the liquid to the periphery and discharge as a spray of droplets. The atomiser may have a serrated perimeter so that the liquid is discharged at a series of points of small dimensions, and it may have radial grooves to feed the liquid to these points. Such a design is based on the observation that the best results in terms of droplet size and uniformity of size, are obtained if the liquid issues as discrete filaments which are broken up into droplets after leaving the atomiser.

For many uses a single cone will give an adequate delivery of liquid spray, and increasing the size or rotational speed of the cone may allow larger quantities of liquid to be dispensed. However, there are practical limitations to the size and speed of the single cones and an alternative approach is to use a stack or two or more cones nesting within each other. My U.K. Pat. Specification No. 716865, for example, shows a nest of cones held together by bolts.

When using a stack of cones it is obviously necessary that the cones should be spaced apart to allow flow of liquid into and along the cones and that the cones should be rigidly held. The present invention is concerned with a particular, simple but effective method of spacing the cones and holding them together.

According to the present invention a rotary atomiser comprises two or more hollow, truncated, rotatable cones nesting within each other; each cone having a toothed periphery, a large number of radial grooves on the inner side of the cone, and a small number of ribs on the outer side of the one mating with some only of the grooves to space the cones apart, a stationary spindle passing axially through the nest of cones and thrust bearings between the ends of the spindle and the end cones of other end pieces to hold the nest of cones as a rigid unit.

In the assembly of the present invention the spacing apart of the cones is effected by co-operation between the ribs and grooves. Spacing of cones is necessary to prevent liquid from becoming trapped between the cones under capillary forces. Clearly to effect spacing, the height of each rib will have to be greater than the depth of the grooves. The ribs may be, for example, twice the depth of the grooves, and the number of ribs may be as low as four, thereby minimizing the number of grooves which are rendered inoperative for feeding liquid to the teeth. A practical upper limit for the number of ribs may be 20. The number of grooves can vary depending on the size of the atomiser and is preferably as high as possible consistent with manufacturing limitations, e.g., from 50 to 500.

Other features of the cones may be as for single cone assemblies. Thus the angle of the cone may vary but may conveniently be from 45° to 75°, and preferably about 60°. The angle of the cone, for a given rotational speed, regulates the centrifugal force which feeds the liquid along the grooves, and the preferred relatively large angles gives a show even feed to the teeth, the grooves acting in effect as a reservoir for the liquid along with the center part of the cone.

The cones may be manufactured by injection moulding from a suitable plastic, e.g., polypropylene or acetal.

The grooves may lead to the teeth or to the angle between adjacent teeth. The teeth may also be in the form of a turned-over lip which is at right angles to the axis of the cone. Where the inside of the cone turns over to form the toothed lip, the angle may be rounded to form a smooth curve from the inside of the cone to the tip of each tooth.

The teeth may be symmetrical, in which case the grooves preferably lead to the teeth themselves, or they may be asymmetrical with one side radial and the other side at an angle to the radius, in which case the grooves preferably lead to the angle between adjacent teeth. My U.K. Pat. Specification No. 1515511 describes and claims broadly a grooved, conical atomiser and specifically describes an atomiser with symmetrical teeth and grooves. A rotary atomiser formed of a hollow truncated cone with asymmetric teeth is described in my copending U.S. Patent Application Serial No. 942,158. In this preferred embodiment the atomiser is rotated so that the radial edge of each tooth is the leading edge. Each groove leads to the angle between adjacent teeth, and by rotating the disc in the direction indicated each stream of liquid is encouraged to travel along the radial side of the adjacent tooth rather than the angled side of the next tooth. When the teeth are in the form of a turned-over lip, the rounded contour between the inside of the cone and the teeth is also important in ensuring a smooth and even transfer of liquid from the grooves to the tips of the teeth.

The grooves may be asymmetric with one side at 90° and the other at an angle of 30° to 60°, preferably at 45°. As previously indicated the grooves lead to the angles between the teeth, so if these angles are continued onto the teeth, the teeth will be asymmetric also with one radial edge and one edge theoretically at 45° to the radius. In practice, the preferred technique of manufacture by injection molding will tend to give a convex curved edge on the nonradial side of each tooth. The nonradial edge may thus be straigth or curved, and the angle, or average angle with a curved surface, is not critical but may conveniently be from 30° to 60° and preferably 45°.

Another important feature of the present invention is that the nest of cones is held onto a central stationary spindle by thrust bearings, thereby obviating the need for bolts, studs, etc. to hold the assembly together. The cones will have central holes through their bases to allow the spindle to pass through the assembly with a small clearance.

The cones at either end of the assembly may house the bearings, but preferably the bearings are housed in separate conical members at either end of the assembly, which may be of the same general shape as the atomising cones with ribs and grooves as necessary to hold the assembly together but without lips and teeth.

In the stacked assembly, the central spindle may be hollow, and liquid may be fed through it. One or more holes from the interior to the exterior of the spindle slightly above the point where the spindle passes through each cone allows the liquid to pass from the center of the spindle to the inside of each cone. The spindle may be notched where it passes through the cones to minimize passage of liquid from one cone to another through the clearance gaps.

The bearings should be thrust bearings to hold the assembly together. Needle and thrust bearings are preferred for long stacks but, for shorter stacks, simpler self-aligning cup and cone bearings may be adequate.

The total number of cones in a stack will depend on the total liquid delivery rate required but may conveniently be from 2 to 10.

The design of the cones with radial grooves and a toothed periphery ensures that the liquid is fed as separate streams along the inside of the cone and onto the tip of each tooth. Once this is achieved, then control of the size of the droplets can be regulated by regulating the rate of feed of liquid to the atomiser. For a given rotational speed, higher feed rates give larger streams and filaments and hence larger droplets, and it has been found that droplet size can be controlled by feed rate to give reasonably uniform size droplets of any size within the range of 30 to 300 microns. For a given feed rate, decreasing the rotational speed also increases the droplet size.

The present invention which provides a simple method for forming an assembly of cones gives further flexibility in relating total liquid feed rate and droplet size and allows high liquid feed rates without excessive rotational speeds and with good control over droplet size.

There are thus various parameters which can be used to regulate droplet size and this gives considerable flexibility in designing spraying equipment particularly as regards the size of the sprayer and its rate of delivery. It is a particular feature of the atomisers of the present invention that they can be used for larger sprayers, e.g., tractor or aircraft mounted sprayers as well as the smaller hand-held sprayers.

The invention is illustrated with reference to the accompanying drawings in which FIG. 1 is a section through a stack of atomisers and FIG. 1(B) is a view taken from direction B of FIG. 1.

FIG. 1 shows a stack of cones formed of three individual cones 11, 12, 13. The design of these cones is more particularly described in my copending U.S. Patent Application Serial No. 942,158 and is included here as illustrative only of a preferred design of cone.

In FIG. 1 each hollow truncated cone 11, 12, 13 has a flat base, 20, 21, 22, and a skirt 2, 2*a* and 2*b*, inclined at an angle of 60° to the axis of the cone. On the inside of the skirt are radial grooves, 3, 3*a* and 3*b*, there being 180 in all. The top of the skirt is turned over to form a lip 4, 4*a* and 4*b* at right angles to the central axis of the cone, and the inner surface of the cone has a smooth rounded contour 5, 5*a* and 5*b*, where the angle changes. The lip is formed of 180 teeth 6, the shape of which is shown by the detail (FIG. 1(B)) which is a view from direction B. It will be seen that each tooth 6 has one edge which is radial with respect to the central axis of the cone and one edge which is curved and is disposed at an angle to the radius. Each groove 3 is asymmetric, one side being at 90° and the other at 45°, and the top of each groove 3 is of the same width and contour as the gap between the teeth to give a smooth feed-way for liquid from each groove to each tooth. The direction of rotation is counterclockwise as shown by the arrow of FIG. 1(B) so that the radial edge of each tooth is the leading edge.

In the stacked assembly of atomisers according to the invention the three cones 11, 12, 13 have central holes 14, 15, 16 in their bases. They also have, on their under surfaces, ribs 17, 18, 19. Each cone has six ribs which are twice the depth of grooves 3 but of the same contour. The six ribs seating in six corresponding grooves therefore keep the cones in a fixed, spaced apart position. Each rib terminates at a point above the flat bases 20, 21, 22 of the cones.

The stack of cones is held together by end members 23, 24 of the same conical shape as the cones. Bottom end member 23 has six grooves to mate with ribs 17 of the bottom cone 11 but has no other grooves and no lip. Top end member 24 has six ribs 25 to mate with six of the grooves 3 of top cone 13 but has no grooves or lip. It also has a hollow central shaft 26. A hollow central spindle 27 runs through the assembly, and there are combined needle and thrust bearings 28, 29 at either end of the spindle fitting into hollow portions of the end members 23, 24. The top end of the spindle has a shoulder 30 and the bottom end is screw threaded to receive nuts 31 so that the whole assembly is firmly held together.

Spindle 27 is hollow for most of its length and it has holes 32, 33, 34 from the interior to the exterior just above where the spindle passes through bases 20, 21, 22 of the cones. There are clearances between the spindle and the bases and, in this area of the assembly, the spindle has a serrated contour so that, just above each base the spindle has a diameter only slightly less than the diameter of the central holes 14, 15, 16 of the bases.

In operation the cones 11, 12, 13 and end members 23, 24 are rotated about the stationary central spindle 27 with the direction of rotation shown in FIG. 1(B) so that the radial edge of each tooth is the leading edge. Liquid is fed under gravity or, preferably, under pressure to the hollow interior of the spindle 27 and passes through holes 32, 33, 34 to the inside of each cone. The serrated contour of the spindle where it passes through the cones helps to minimize any tendency for the liquid to fall under gravity from one cone to the next and hence overload the bottom cone.

As the cones are rotated, separate discrete streams of liquid are drawn along each groove of each cone. When the liquid reaches the lip, the rotation of the cone causes each stream to cling to the leading radial edge of each corresponding tooth and not to partition itself between adjacent teeth. Even if the air flow over the teeth caused by the rotation interferes with flow along the radial edge to such an extent that some liquid is carried across a tooth to its other non-radial edge, surface tension and centrifugal force will still encourage this liquid to travel along the non-radial edge to the tip of the tooth rather than transferring to the adjacent tooth. Consequently, each stream is discharged from the tip of each tooth as separate, discrete, filaments of uniform diameter. As the filaments are thrown off from the teeth into the surrounding air they break up into uniform, small size droplets.

I claim:

1. A rotary atomizer comprising:

a plurality of concentric hollow cones nested within one another and adapted to be rotated about their central axis, each cone having a base at its narrow end and a toothed peripheral edge of its wide end;

a large number of radial grooves on the inner surfaces of the cones for directing streams of liquid to be atomized outwardly to the toothed peripheries of the cones;

a small number of ribs on the outer surfaces of the cones mating with only some of the grooves on adjacent cones to space the cones apart;

a stationary spindle passing axially through said cones; and thrust bearings between said cones and said spindle for holding said cones together for rotation as a rigid unit.

2. A rotary atomiser as claimed in claim 1 having from 4 to 20 ribs.

3. A rotary atomiser as claimed in claim 2 having from 50 to 500 grooves.

4. A rotary atomiser as claimed in claim 1 having separate conical members at either end of the assembly in which the bearings are housed.

5. A rotary atomiser as claimed in claim 1 wherein the spindle is hollow and has one or more holes from the interior to the exterior slightly above the point where it passes through each cone.

6. A rotary atomiser as claimed in claim 1 wherein the spindle is notched where it passes through the cones.

7. A rotary atomiser as claimed in claim 1 wherein the bearings are needle and thrust bearings.

* * * * *